US011132954B2

(12) United States Patent
Keum

(10) Patent No.: US 11,132,954 B2
(45) Date of Patent: Sep. 28, 2021

(54) DISPLAY DEVICE AND DRIVING METHOD THEREOF

(71) Applicant: Samsung Display Co., Ltd., Yongin-si (KR)

(72) Inventor: Min Ha Keum, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 12 days.

(21) Appl. No.: 16/260,415

(22) Filed: Jan. 29, 2019

(65) Prior Publication Data

US 2019/0237025 A1 Aug. 1, 2019

(30) Foreign Application Priority Data

Feb. 1, 2018 (KR) ..... 10-2018-0013045

(51) Int. Cl.

| | |
|---|---|
| ***G09G 3/3291*** | (2016.01) |
| ***G09G 3/3266*** | (2016.01) |
| ***G09G 3/3233*** | (2016.01) |
| ***G09G 3/3258*** | (2016.01) |

(52) U.S. Cl.

CPC ..... *G09G 3/3291* (2013.01); *G09G 3/3233* (2013.01); *G09G 3/3258* (2013.01); *G09G 3/3266* (2013.01); *G09G 2300/0426* (2013.01); *G09G 2300/0439* (2013.01); *G09G 2300/0809* (2013.01); *G09G 2310/027* (2013.01); *G09G 2310/08* (2013.01); *G09G 2330/021* (2013.01); *G09G 2360/12* (2013.01)

(58) Field of Classification Search

None

See application file for complete search history.

(56) References Cited

U.S. PATENT DOCUMENTS

2009/0115907 A1* 5/2009 Baba ..... G09G 3/3406 348/672

2016/0140894 A1* 5/2016 Eun ..... H04N 13/341 345/212

FOREIGN PATENT DOCUMENTS

KR 10-2017-0066771 6/2017

* cited by examiner

*Primary Examiner* — Stephen T. Reed

(74) *Attorney, Agent, or Firm* — H.C. Park & Associates, PLC

(57) ABSTRACT

A display device includes: organic light emitting diodes configured to emit light depending on grayscales constituting a target frame; a power voltage supplier configured to supply a power voltage to one electrode of each of the organic light emitting diodes; and a power voltage determiner configured to: extract target grayscales in descending order from a highest grayscale among the grayscales; and determine a voltage value of the power voltage based on each number of the target grayscales.

15 Claims, 8 Drawing Sheets

DISPLAY DEVICE AND DRIVING METHOD THEREOF

CROSS-REFERENCE TO RELATED APPLICATION

This application claims priority from and the benefit of Korean Patent Application No. 10-2018-0013045, filed on Feb. 1, 2018, which is hereby incorporated by reference for all purposes as if fully set forth herein.

BACKGROUND

Field

Exemplary embodiments/implementations of the invention relate generally to a display device and a driving method thereof.

Discussion of the Background

With the development of information technologies, the importance of a display device which is a connection medium between a user and information increases. Accordingly, display devices such as a liquid crystal display device, an organic light emitting display device, and a plasma display device are increasingly used.

Among the display devices, the organic light emitting display device displays an image by using organic light emitting diodes generating light by recombination of electrons and holes. This is advantageous in that it has a fast response speed and is driven with low power consumption.

In recent years, techniques for adjusting a power voltage supplied to organic light emitting diodes have been receiving attention in order to further reduce power consumption. However, when the supplied power voltage is reduced, the organic light emitting diodes may not emit light at a corresponding luminance with respect to a high grayscale data, and therefore image degradation may be recognized.

The above information disclosed in this Background section is only for understanding of the background of the inventive concepts, and, therefore, it may contain information that does not constitute prior art.

SUMMARY

Devices constructed and methods according to exemplary embodiments of the invention are capable of appropriately balancing the tradeoff relationship between power consumption reduction and image quality.

Additional features of the inventive concepts will be set forth in the description which follows, and in part will be apparent from the description, or may be learned by practice of the inventive concepts.

According to one or more embodiments of the invention, a display device includes: organic light emitting diodes configured to emit light depending on grayscales constituting a target frame; a power voltage supplier configured to supply a power voltage to one electrode of each of the organic light emitting diodes; and a power voltage determiner configured to: extract target grayscales in descending order from a highest grayscale among the grayscales; and determine a voltage value of the power voltage based on each number of the target grayscales.

The power voltage determiner may be configured to: compare each number of the target grayscales with a grayscale reference number, and may determine the voltage value of the power voltage based on a selected target grayscale which is a highest grayscale among the target grayscales having a number exceeding the grayscale reference number.

The one electrode of each of the organic light emitting diodes may be a cathode electrode.

The power voltage determiner may include a control value look-up table including power voltage control values corresponding to the grayscales, wherein the power voltage determiner may be configured to provide a power voltage control value corresponding to the selected target grayscale to the power voltage supplier. Each of the power voltage control values may correspond to a smaller power voltage as each of the power voltage control values corresponds to a higher grayscale.

Each of the power voltage control values may correspond to the power voltage having the voltage value causing an insufficient luminance for higher grayscales than each of the grayscales corresponding to each of the power voltage control values.

The one electrode of each of the organic light emitting diodes may be an anode electrode.

The power voltage determiner may include a control value look-up table including power voltage control values corresponding to the grayscales, wherein the power voltage determiner may be configured to provide a power voltage control value corresponding to the selected target grayscale to the power voltage supplier. Each of the power voltage control values may correspond to a bigger power voltage as each of the power voltage control values corresponds to a higher grayscale.

The power voltage determiner may include a reference number look-up table including grayscale reference numbers corresponding to the grayscales, respectively, and wherein the power voltage determiner may be configured to: compare each number of the target grayscales with corresponding target grayscale reference number among the grayscale reference numbers; and determine the voltage value of the power voltage based on a selected target grayscale which is a highest grayscale among the target grayscales having a number exceeding the corresponding target grayscale reference number.

The one electrode of each of the organic light emitting diodes may be a cathode electrode.

The power voltage determiner may include a control value look-up table including power voltage control values corresponding to the grayscales, wherein the power voltage determiner may be configured to provide a power voltage control value corresponding to the selected target grayscale to the power voltage supplier. Each of the power voltage control values may correspond to a smaller power voltage as each of the power voltage control values corresponds to a higher grayscale.

Each of the power voltage control values may correspond to the power voltage having the voltage value causing an insufficient luminance for higher grayscales than each of the grayscales corresponding to each of the power voltage control values.

The one electrode of each of the organic light emitting diodes may be an anode electrode.

The power voltage determiner may include a control value look-up table including power voltage control values corresponding to the grayscales, wherein the power voltage determiner may be configured to provide a power voltage control value corresponding to the selected target grayscale to the power voltage supplier. Each of the power voltage control value may correspond to a bigger power voltage as each of the power voltage control values corresponds to a higher grayscale.

According to one or more embodiments of the invention, a display device includes: organic light emitting diodes configured to emit light depending on grayscales constituting a target frame; a power voltage supplier configured to supply a power voltage to one electrode of each of the organic light emitting diodes; and a power voltage determiner configured to: extract target sections in descending order from a section having a highest grayscale among sections, each of the sections having at least two of the grayscales as a group, and determine a voltage value of the power voltage based on each number of the target sections.

The power voltage determiner may be configured to: compare each number of the target sections with a section reference number; and determine the voltage value of the power voltage based on a selected target section having a highest grayscale among the target sections having a number exceeding the section reference number.

The one electrode of each of the organic light emitting diodes may be a cathode electrode.

The power voltage determiner may include a control value look-up table including power voltage control values corresponding to the sections, wherein the power voltage determiner may be configured to provide a power voltage control value corresponding to the selected target section to the power voltage supplier. Each of the power voltage control value may correspond to a smaller power voltage as each of the power voltage control values corresponds to a higher grayscale section.

Each of the power voltage control values may correspond to the power voltage having the voltage value causing an insufficient luminance for higher grayscales than a highest grayscale of each of the sections corresponding to each of the power voltage control values.

According to one or more embodiments of the invention, a driving method of a display device includes: extracting target grayscales in descending order from a highest grayscale among grayscales constituting a target frame; counting each number of the target grayscales; determining a voltage value of a power voltage based on each number of the target grayscales; and supplying the power voltage to one electrode of each of organic light emitting diodes.

According to one or more embodiments of the invention, a driving method of a display device includes: extracting target sections in descending order from a section including a highest grayscale among sections, wherein each of the sections has at least two of grayscales as a group, and wherein the grayscales constitute a target frame; counting each number of the target sections; determining a voltage value of a power voltage based on each number of the target sections; and supplying the power voltage to one electrode of each of organic light emitting diodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
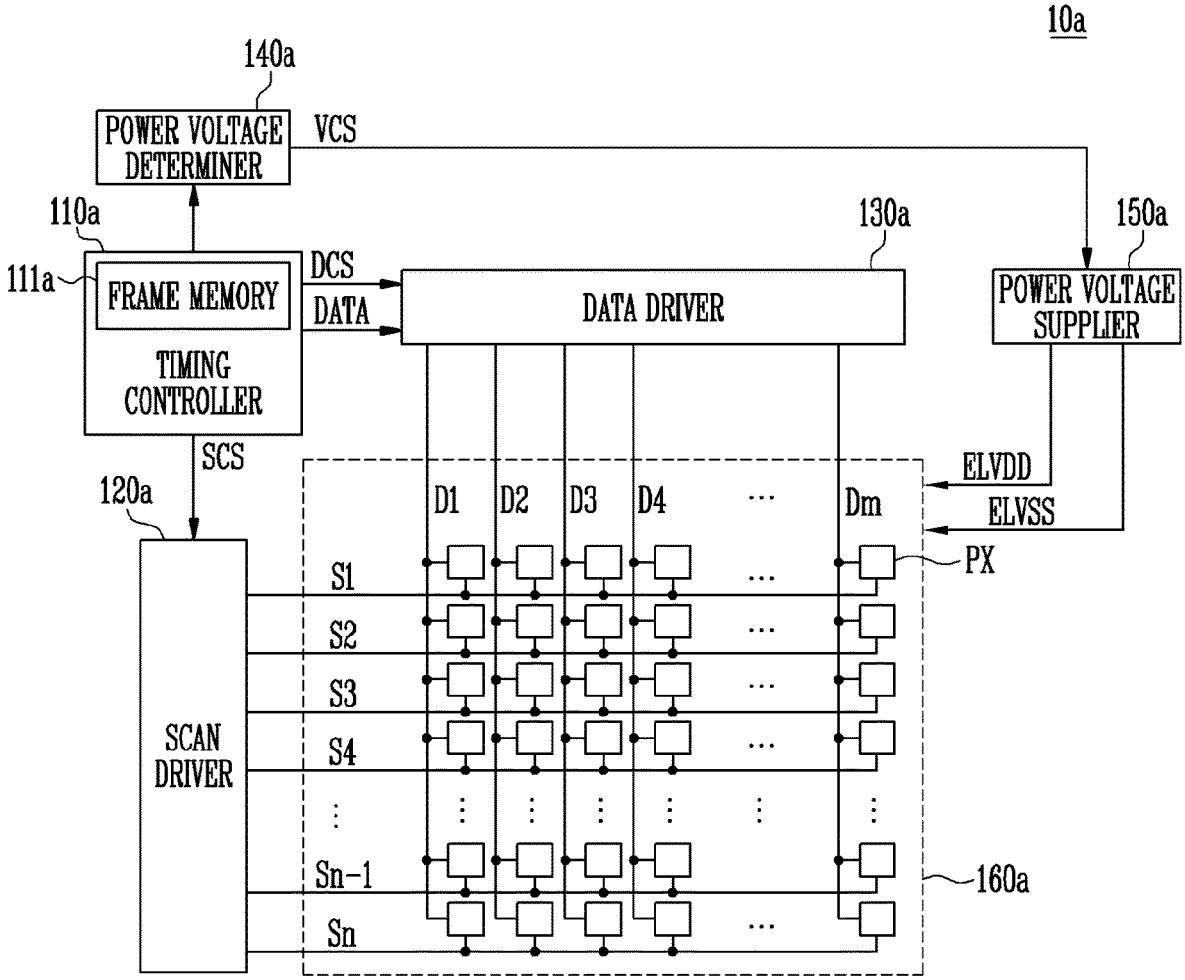
FIG. 1 is a schematic diagram of a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

A part that is irrelevant to the description may be omitted to clearly describe the present inventive concepts, and the same or similar constituent elements will be designated by the same reference numerals throughout the specification. Therefore, the same reference numerals may be used in different drawings to identify the same or similar elements.

In addition, the size and thickness of each component illustrated in the drawings are arbitrarily shown for better understanding and ease of description, but the present disclosure is not limited thereto. Thicknesses of several portions and regions are exaggerated for clear expressions.

Figure 2:
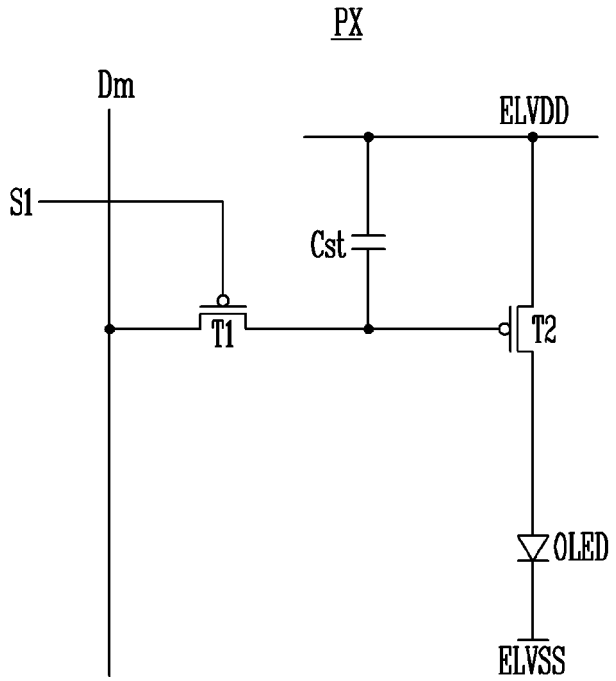
FIG. 2 is a schematic diagram of a pixel according to an exemplary embodiment.

FIG. 1 is a schematic diagram of a display device according to an exemplary embodiment. FIG. 2 is a schematic diagram of a pixel according to an exemplary embodiment.

Referring to FIG. 1, a display device 10*a* according to an exemplary embodiment includes a timing controller 110*a*, a scan driver 120*a*, a data driver 130*a*, a power voltage determiner 140*a*, a power voltage supplier 150*a*, and a pixel unit 160*a*.

The timing controller 110*a* receives a control signal and an image signal from a host system such as an external application processor (AP) or the like. The control signal may include a vertical synchronization signal, a horizontal synchronization signal, a data enable signal, and the like. The image signal may include a red image signal, a blue image signal, a green image signal, or the like. The vertical synchronization signal may be an indicator capable of distinguishing one image frame constituted by the image signals. The horizontal synchronization signal may be an indicator capable of distinguishing the image frame by each pixel row. The data enable signal may be an indicator indicating whether the image signals are being transmitted.

By using the control signal and the image signal, the timing controller 110*a* transmits an image signal DATA corrected according to the specifications of the data driver 130*a* and a data control signal DCS to control the image signal DATA to the data driver 130*a*. The timing controller 110*a* may also transmit a scan control signal SCS including a clock signal or the like to the scan driver 120*a*.

The timing controller 110*a* may include a frame memory 111*a* capable of storing the image signals for the image frame. In exemplary embodiments, the frame memory 111*a* may be separately positioned at the outside of the timing controller 110*a*.

The scan driver 120*a* generates scan signals using the scan control signal SCS. The generated scan signals may be supplied to the corresponding scan lines S1, S2, S3, S4, . . . , Sn−1, and Sn. According to exemplary embodiments, the scan signals may be sequentially supplied to the corresponding scan lines S1 to Sn, or may be supplied in a partially overlapped state. The scan signal supplied may be a voltage having a voltage value capable of turning on the corresponding scan transistor. The scan driver 120*a* may include stage circuits corresponding to each of the scan lines S1 to Sn and the stage circuits may be connected in a shift register form and configured to operate based on an output signal of the previous stage circuit.

The scan driver 120*a* may be provided when the pixel unit 160*a* is formed, may be provided in an IC chip form together with the data driver 130*a* and the timing controller 110*a*, or may be provided in a separate IC chip form.

The data driver 130*a* may generate data voltages corresponding to data lines D1, D2, D3, D4, . . . , and Dm using the image signal DATA and the data control signal DCS. The generated data voltages may be sequentially supplied to the corresponding data lines D1, D2, D3, D4, . . . , Dm in units of pixel rows. Each data voltage corresponds to a grayscale of each pixel.

The power voltage determiner 140*a* may determine at least one voltage value of power voltages ELVDD and ELVSS to be supplied from the power voltage supplier 150*a*. The power voltage determiner 140*a* may be provided in an IC chip form together with the timing controller 110*a* or may be provided in a separate IC chip form. The power voltage supplier 150*a* may be a separate DC-DC converter or may be provided in an IC chip form together with the data driver 130*a*.

For example, the power voltage determiner 140*a* may extract target grayscales in descending order from a highest grayscale among grayscales constituting a target frame. The power voltage determiner 140*a* may determine a voltage value of the power voltage ELVDD or ELVSS based on each number of the target grayscales. The target frame is an image frame used for determination of the power voltage ELVDD or ELVSS, among the image frames constituting a video image or a still image. The target frame may be every image frame, two or more image frames, or an image frame periodically selected or randomly selected. Related embodiments will be described in detail below with reference to FIGS. 3, 4, 7, and 8.

Also, for example, the power voltage determiner 140*a* may extract target sections in descending order from a section including a highest grayscale among sections, wherein each of the sections has at least two of the grayscales as a group, and wherein the grayscales constitute the target frame. The power voltage determiner 140*a* may determine a voltage value of the power voltage ELVDD or ELVSS based on each number of the target sections. Related embodiments will be described in detail below with reference to FIGS. 5 and 6.

The power voltage determiner 140*a* may provide a power voltage control value VCS for determining the voltage value of the power voltage ELVDD or ELVSS to the power voltage supplier 150*a*.

The power voltage supplier 150*a* supplies the power voltages ELVDD and ELVSS to the pixel unit 160*a*. The power voltage supplier 150*a* may adjust the voltage level of at least one of the power voltages ELVDD and ELVSS based on the power voltage control value VCS. The voltage value of the power voltage ELVDD may be bigger than the voltage value of the power voltage ELVSS. Each pixel PX constituting the pixel unit 160 includes at least one organic light emitting diode. A driving current path may be formed between the power voltage ELVDD applied to an anode electrode of the organic light emitting diode and the power voltage ELVSS applied to a cathode electrode of the organic light emitting diode. A width of the driving current path may be controlled by a driving transistor of each pixel PX based on the data voltage, so that the organic light emitting diode can emit light with a desired grayscale.

The pixel unit 160*a* includes the pixels PX. The pixels PX may be arranged in a substantially matrix form. Each pixel row is connected to the corresponding same scan line S1 to Sn, and each pixel column is connected to the corresponding same data line D1 to Dm. Each pixel row selected by the scan signal supplied through the scan lines S1 to Sn receives the data voltage through the data lines D1 to Dm.

An exemplary configuration and operation of each pixel PX will be described in more detail with reference to FIG. 2. In FIG. 2, the pixel PX connected to the scan line S1 and the data line Dm is illustrated as an example.

The pixel PX may include a first transistor T1 and a second transistor T2, a storage capacitor Cst, and an organic light emitting diode OLED.

One electrode of the first transistor T1 is connected to the data line Dm, the other electrode of the first transistor T1 is connected to a gate electrode of the second transistor T2, and a gate electrode of the first transistor T1 is connected to the scan line S1. The first transistor T1 may be referred to as a scan transistor.

One electrode of the second transistor T2 is connected to the power voltage ELVDD, the other electrode of the second transistor T2 is connected to an anode electrode of the organic light emitting diode OLED, and a gate electrode of the second transistor T2 is connected to the other electrode of the first transistor T1. In exemplary embodiments, the one electrode of the second transistor T2 may be connected to a cathode electrode of the organic light emitting diode OLED, the other electrode of the second transistor T2 may be connected to the power voltage ELVSS, and the gate electrode of the second transistor T2 may be connected to the other electrode of the first transistor T1. The second transistor T2 may be referred to as a driving transistor.

One electrode of the storage capacitor Cst is connected to the power voltage ELVDD and the other electrode of the storage capacitor Cst is connected to the gate electrode of the second transistor T2. In exemplary embodiments, the one electrode of the storage capacitor Cst may be connected to the gate electrode of the second transistor T2, and the other electrode of the storage capacitor Cst may be connected to the power voltage ELVSS. In exemplary embodiments, the one electrode of the storage capacitor Cst may be connected to a specific voltage source, and the other electrode of the storage capacitor Cst may be connected to the gate electrode of the second transistor T2.

In the organic light emitting diode OLED, the anode electrode is connected to the other electrode of the second transistor T2, and the cathode electrode is connected to the power voltage ELVSS. In exemplary embodiments, the anode electrode of the organic light emitting diode OLED may be connected to the power voltage ELVDD, and the cathode electrode thereof may be connected to the one electrode of the second transistor T2. The organic light emitting diode OLED may include an organic light emitting layer capable of emitting light in one of red, blue, and green colors. In exemplary embodiments, the organic light emitting diode OLED may include an organic light emitting layer capable of emitting light in another color other than red, blue, and green.

The above-described embodiment and modified embodiments have exemplified the case where the first and second transistors T1 and T2 are composed of P-type transistors. However, those skilled in the art will be able to design a pixel circuit having the same function by configuring the first and second transistors T1 and T2 as N-type transistors, or N-type and P-type transistors. A P-type transistor collectively refers to a transistor that is turned on when a voltage applied to a gate electrode is lower than a voltage applied to a source electrode. An N-type transistor collectively refers to a transistor that is turned on when a voltage applied to a gate electrode is higher than a voltage applied to a source electrode.

Hereinafter, a driving method of the pixel PX will be described.

When a scan signal of a turn-on level is applied to the scan line S1, the first transistor T1 is turned on to connect the data line Dm and the other electrode of the storage capacitor Cst at the same node. In order to simplify the explanation, the loss or the voltage drop due to wires or transistors is not considered.

Therefore, the data voltage applied to the data line Dm is applied to the other electrode of the storage capacitor Cst. The storage capacitor Cst records and maintains the potential difference between the power voltage ELVDD and the data voltage.

The second transistor T2 conducts the driving current path between the power voltage ELVDD and the power voltage ELVSS in accordance with the potential difference recorded in the storage capacitor Cst. The organic light emitting diode OLED emits light at a desired gray level in proportion to the amount of driving current flowing depending on the conduction degree of the driving current path.

Figure 3:
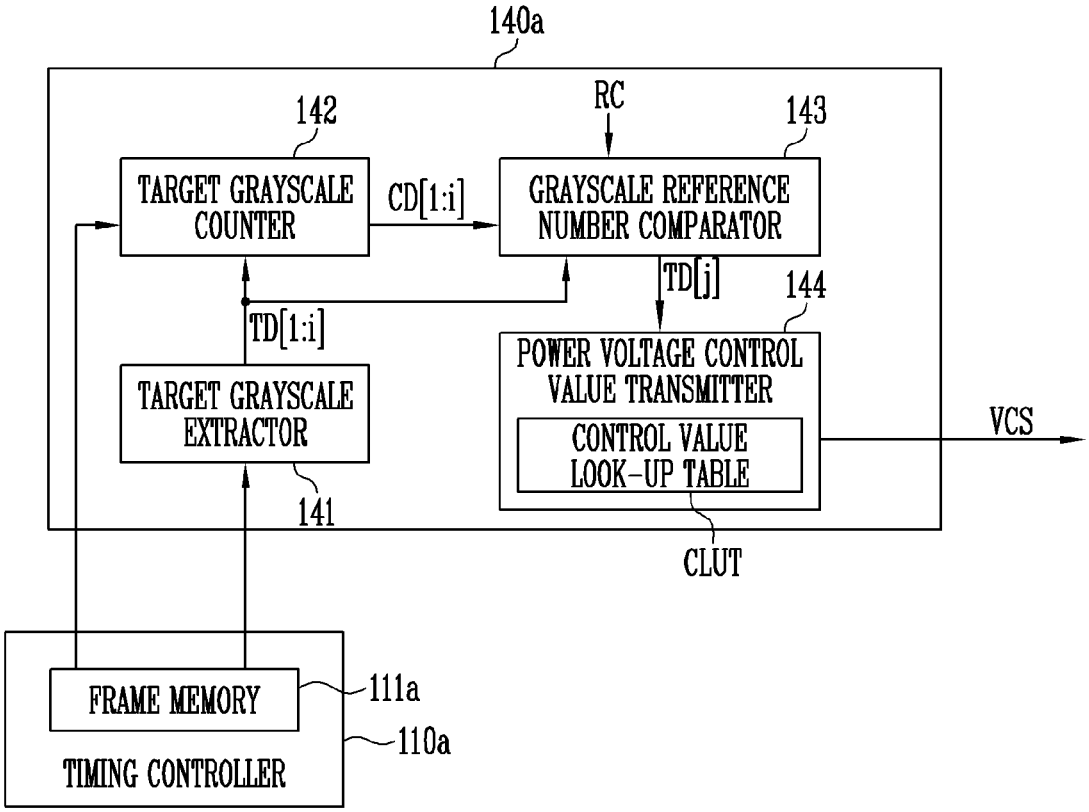
FIG. 3 is a schematic diagram of a power voltage determiner according to a first exemplary embodiment.
Figure 4:
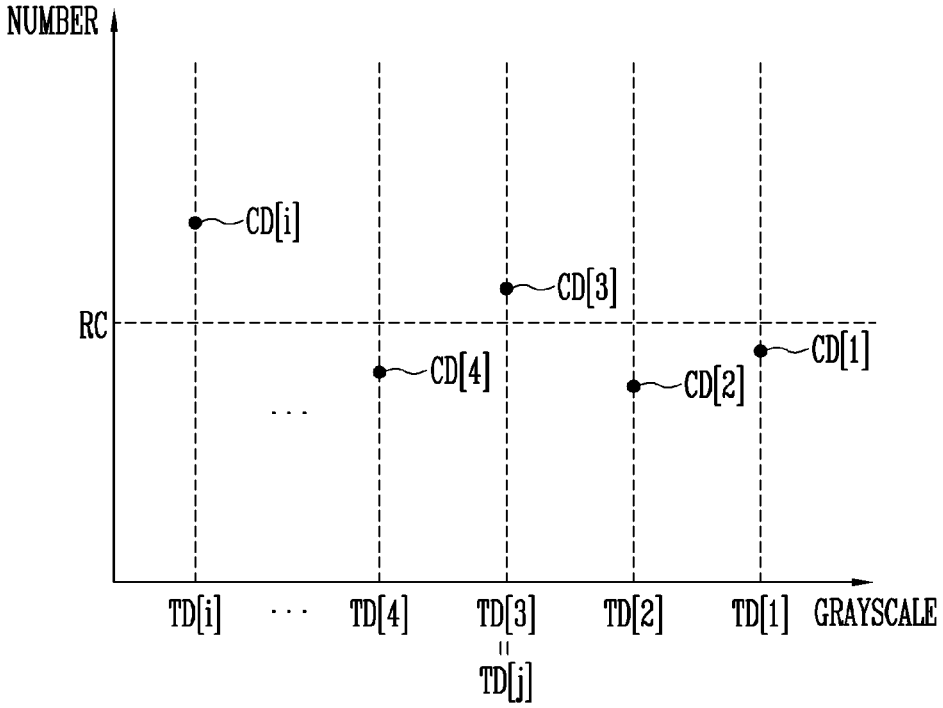
FIG. 4 is a diagram illustrating a procedure for determining a power voltage control value by the power voltage determiner of the first exemplary embodiment.

FIG. 3 is a schematic diagram of a power voltage determiner according to a first exemplary embodiment. FIG. 4 is a diagram illustrating a procedure for determining a power voltage control value by the power voltage determiner of the first exemplary embodiment.

Referring to FIG. 3, the power voltage determiner 140*a* according to the first exemplary embodiment may include a target grayscale extractor 141, a target grayscale counter 142, a grayscale reference number comparator 143, a power voltage control value transmitter 144, and a control value lookup table CLUT.

Referring to FIGS. 3 and 4, the power voltage determiner 140*a* may extract target grayscales TD[1:i] in descending order from a highest grayscale among the grayscales constituting the target frame, compare respective numbers CD[1:i] of the target grayscales TD[1:i] with a grayscale reference number RC, and determine the voltage value of the power voltage ELVSS or ELVDD based on a selected target grayscale TD[j] which is the highest grayscale among the target grayscales each having a number exceeding the grayscale reference number RC. This procedure will be described in more detail below.

The frame memory 111*a* stores information on the grayscales constituting the target frame per each pixel.

Firstly, the target grayscale extractor 141 may search for the highest grayscale among the grayscales constituting the target frame from the frame memory 111*a*. For example, when the image signal for each pixel is composed of 8 bits, the grayscales may have one of 256 levels (28=256). Hereinafter, it is assumed that the 0 level grayscale is the darkest grayscale in the image signal, and the 255 level grayscale is the brightest grayscale in the image signal. In this embodiment, the highest grayscale means the brightest grayscale among the grayscales constituting the target frame, and therefore the highest grayscale is not always the 255 level grayscale. For example, when the target frame corresponds to a bright scene (for example, a scenery of daytime, sun, or explosion), the grayscales constituting the target frame may be composed of 50 to 250 levels. In this example, the 250 level grayscale corresponds to the highest grayscale among the grayscales of the target frame. In another example, when the target frame corresponds to a dark scene (for example, a scenery of night, cave, or deep sea), the grayscales constituting the target frame may be composed of 0 to 155 levels. In this example, the 155 level grayscale corresponds to the highest grayscale among the grayscales of the target frame. Hereinafter, for convenience of explanation, the case where the grayscales constituting the target frame are composed of 0 to 155 levels will be described as an example.

The target grayscale extractor 141 may extract i grayscales as the target grayscales TD[1: i] in descending order from the searched highest grayscale, where i may be a natural number. The target grayscales TD[1: i] are used to determine the power voltage ELVDD or ELVSS in the power voltage determiner 140*a*, and the other grayscales except the target grayscales TD[1: i] are not used for determination of the power voltage ELVDD or ELVSS. The target grayscales TD[1: i] represent a set of respective grayscales TD[1], TD[2], TD[3], TD[4], . . . , TD[i]. The target grayscale TD[1] among the target grayscales TD[1: i] means the brightest target grayscale, and the target grayscale TD[i] means the darkest target grayscale. For example, when i is 5, TD[1]=155, TD[2]=154, TD[3]=153, TD[4]=152, and TD[5]=151.

The target grayscale counter 142 may count how many target grayscales TD[1: i] are respectively in the target frame, based on the extracted target grayscales TD[1: i], and may provide target grayscale numbers CD[1: i]. For example, a Full HD (FHD) display device may include 1920*1080 pixels PX, and the number of grayscales constituting the target frame corresponds to the number of pixels. For example, the number CD[4] of the target grayscale TD[4] corresponding to the 152 grayscale level may be 10,000, the number CD[3] of the target grayscale TD[3] corresponding to the 153 grayscale level may be 30,000, the number CD[2] of the target grayscale TD[2] corresponding to the 154 grayscale level may be 8,000, and the number CD[1] of target grayscale TD[1] corresponding to the 155 grayscale level may be 15,000, among the total number of 1920*1080 grayscales constituting the target frame.

The grayscale reference number comparator 143 may compare the target grayscale numbers CD[1: i] with the grayscale reference number RC, and may provide a selected target grayscale TD[j] which is the highest grayscale among the target grayscales each having a number exceeding the grayscale reference number RC. For example, when the grayscale reference number RC is 20,000, each of the target grayscale numbers CD[3] and CD[i] exceeds the grayscale reference number RC, and therefore the target grayscale TD[3] which is the highest grayscale between the target grayscales TD[3] and TD[i] is provided as the selected target grayscale TD[j].

The grayscale reference number RC may be experimentally or adaptively determined depending on the product. According to an exemplary embodiment, the grayscale reference number RC may be set between 0.7% and 5% of the total number of pixels PX. According to exemplary embodiments, the grayscale reference number RC may be set to 1% of the total number of pixels PX.

The power voltage control value transmitter 144 may include the control value look-up table CLUT in which power voltage control values corresponding to the grayscales are recorded, and may provide the power voltage control value VCS corresponding to the selected target grayscale TD[j] to the power voltage supplier 150*a*.

The power voltage may be the power voltage ELVSS applied to the cathode electrode of the organic light emitting diode OLED or the power voltage ELVDD applied to the anode electrode of the organic light emitting diode OLED.

When the power voltage ELVSS is controlled, the power voltage control value VCS may correspond to a smaller power voltage as the power voltage control value VCS corresponds to a higher grayscale. In other words, as the selected target grayscale TD[j] has a higher level, the power voltage supplier 150*a* may provide the power voltage ELVSS having a smaller voltage value. Therefore, the required power proportional to the difference between the power voltages ELVDD and ELVSS may be secured. Therefore, when the organic light emitting diode OLED emits light at the selected target grayscale TD[j], luminance degradation may not occur or be reduced.

Each of the power voltage control values VCS may correspond to the power voltage ELVSS having the voltage value causing an insufficient luminance for higher grayscales than the grayscale corresponding to each of the power voltage control values VCS. That is, for example, the power supplied in accordance with the power voltage control value VCS is sufficient for the organic light emitting diode OLED to emit light with the grayscale TD[3] which is the selected target grayscale TD[j]. However, the supplied power may be insufficient for the organic light emitting diode OLED to emit light with the grayscales TD[2] and TD[1] which are higher than the selected target grayscale TD[j]. That is, luminance degradation may occur for higher grayscales than the selected target grayscale TD[j].

Even if such degradation in luminance occurs, the number of pixels with reduced luminance is less than the experimentally predetermined grayscale reference number RC, so that image degradation is less observed. Therefore, according to the exemplary embodiment, it is possible to appropriately balance the tradeoff relationship between power consumption reduction and image quality degradation.

When the power voltage ELVDD is controlled, the power voltage control value VCS may correspond to a bigger power voltage as the power voltage control value VCS corresponds to a higher grayscale. In other words, as the selected target grayscale TD[j] has a higher level, the power voltage supplier 150*a* may provide the power voltage ELVDD having a bigger voltage value. Therefore, the required power proportional to the difference between the power voltages ELVDD and ELVSS may be secured. Therefore, when the organic light emitting diode OLED emits light at the selected target grayscale TD[j], luminance degradation may not occur or be reduced.

Each of the power voltage control values VCS may correspond to the power voltage ELVDD having the voltage value causing an insufficient luminance for higher grayscales than the grayscale corresponding to each of the power voltage control values VCS. That is, for example, the power supplied in accordance with the power voltage control value VCS is sufficient for the organic light emitting diode OLED to emit light with the grayscale TD[3] which is the selected target grayscale TD[j]. However, the supplied power may be insufficient for the organic light emitting diode OLED to emit light with the grayscales TD[2] and TD[1] which are higher than the selected target grayscale TD[j]. That is, luminance degradation may occur for higher grayscales than the selected target grayscale TD[j].

Even if such degradation in luminance occurs, the number of pixels with reduced luminance is less than the experimentally determined grayscale reference number RC, so that image degradation is less observed. Therefore, according to the exemplary embodiment, it is possible to appropriately balance the tradeoff relationship between power consumption reduction and image quality degradation.

Figure 5:
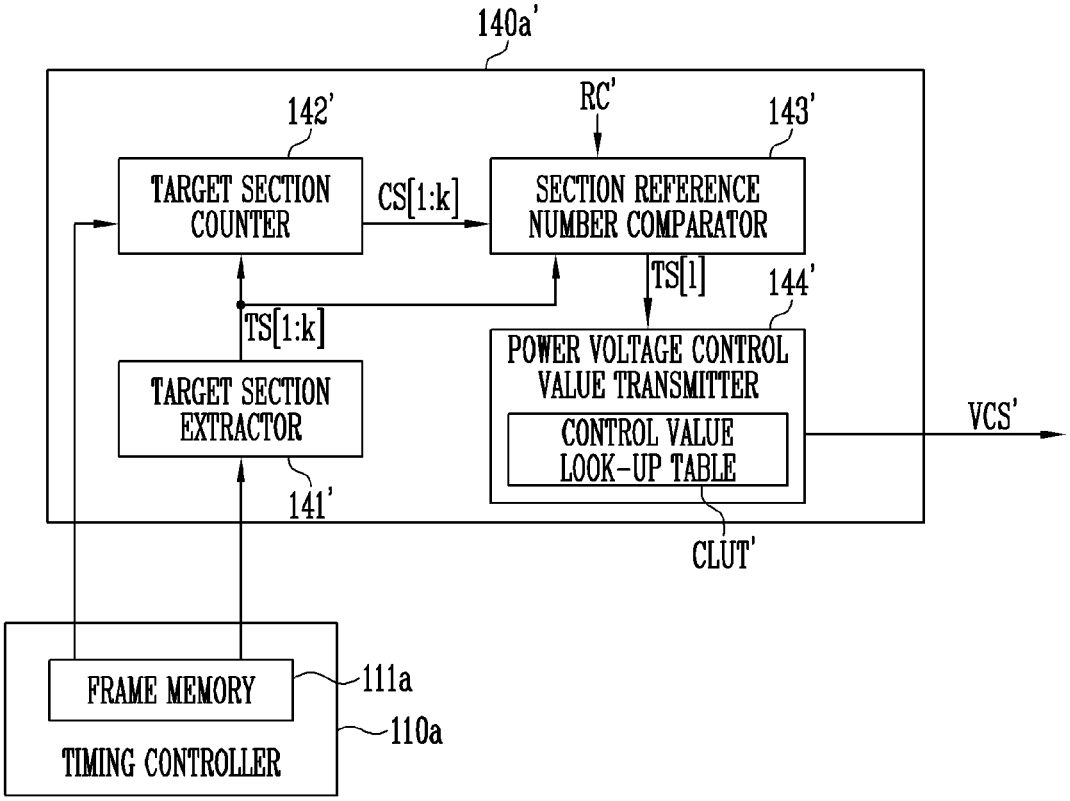
FIG. 5 is a schematic diagram of a power voltage determiner according to a second exemplary embodiment.
Figure 6:
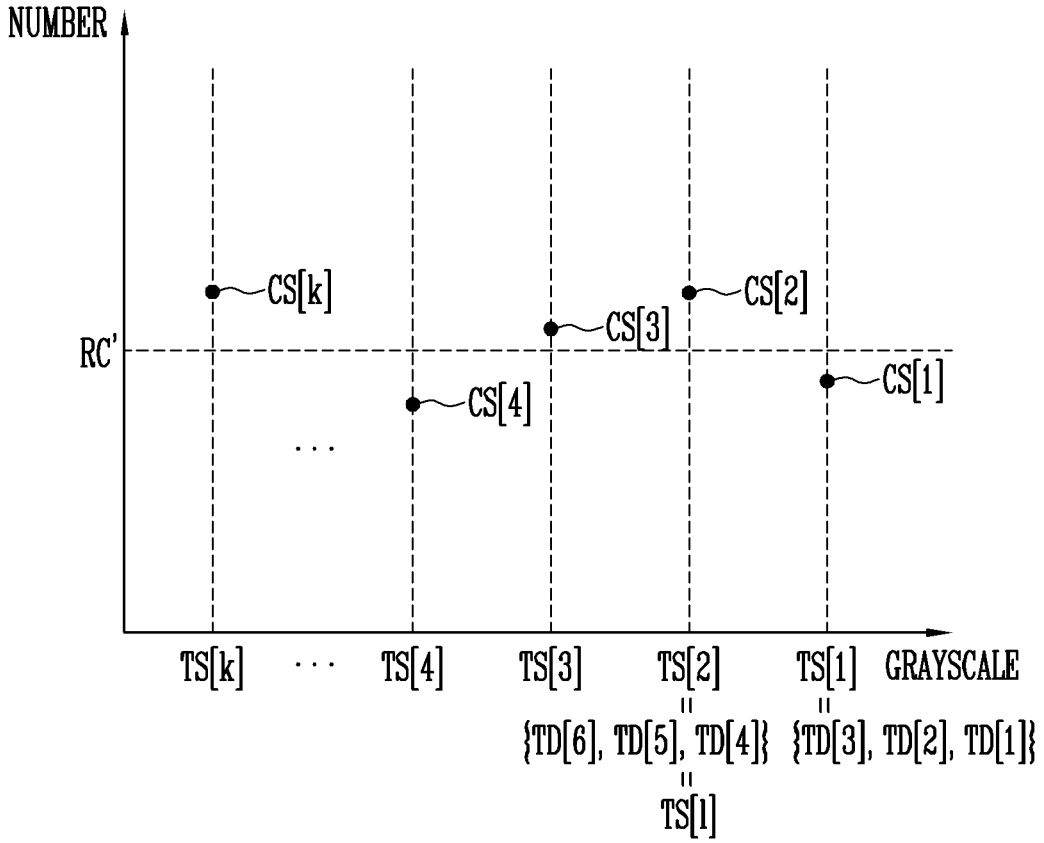
FIG. 6 is a diagram illustrating a procedure for determining a power voltage control value by the power voltage determiner of the second exemplary embodiment.

FIG. 5 is a schematic diagram of a power voltage determiner according to a second exemplary embodiment. FIG. 6 is a diagram illustrating a procedure for determining a power voltage control value by the power voltage determiner of the second exemplary embodiment.

Referring to FIG. 5, a power voltage determiner 140*a*' according to the second exemplary embodiment may include a target section extractor 141', a target section counter 142', a section reference number comparator 143', a power voltage control value transmitter 144', and a control value look-up table CLUT'.

Referring to FIGS. 5 and 6, the power voltage determiner 140*a*' may extract target sections TS[1:k] in descending order from a section including a highest grayscale among sections, wherein each of the sections has at least two of the grayscales as a group, and wherein the grayscales constitute a target frame. The power voltage determiner 140*a*' may compare each number of the target sections TS[1:k] with a section reference number RC', and may determine the voltage value of the power voltage ELVSS or ELVDD based on a selected target section TS [1] having the highest grayscale among the target sections each having a number exceeding the section reference number RC'. This procedure will be described in more detail below.

The frame memory 111*a* stores information on the grayscales constituting the target frame per each pixel.

Firstly, from the frame memory 111*a*, the target section extractor 141' may search for the section having the highest grayscale among the sections, wherein each of the sections has at least two of the grayscales as a group, and wherein the grayscales constitute the target frame. For convenience of explanation, it is assumed below that each section is a group of three grayscales.

The target section extractor 141' may extract k sections as the target sections TS[1: k] in descending order from the section having the searched highest grayscale, where k may be a natural number. The target sections TS[1: k] are used to determine the power voltage ELVDD or ELVSS in the power voltage determiner 140*a*, and the other sections except the target sections TS[1: k] are not used for determination of the power voltage ELVDD or ELVSS. The target sections TS[1: k] represent a set of respective sections TS[1], TS[2], TS[3], TS[4], . . . , TS[k]. The target section TS[1] among the target sections TS[1: k] means that the brightest grayscale is included in this section, and the target section TD[k] means that the darkest grayscale is included in this section. Referring to FIG. 6, for example, the target section TS[1] is composed of grayscales TD[3], TD[2], and TD[1], and the target section TS[2] is composed of grayscales TD[6], TD[5], and TD[4].

The target section counter 142' may count how many target sections TS[1: k] are respectively in the target frame, based on the extracted target sections TS[1: k], and may provide target section numbers CS[1: k]. For example, the target section number CS[2] is the same as the sum of each number of the grayscales TD[6], TD[5], and TD[4] constituting the target section TS[2]. Similarly, the target section number CS[1] is the same as the sum of each number of the grayscales TD[3], TD[2], and TD[1] constituting the target section TS[1].

The section reference number comparator 143' may compare the target section numbers CS[1: k] with the section reference number RC', and may provide a selected target section TS[1] which includes the highest grayscale among the target sections each having a number exceeding the section reference number RC'. Compared with the first exemplary embodiment of FIGS. 3 and 4, the section reference number RC' may be equal to a value obtained by multiplying the grayscale reference number RC by the number of grayscales included in each section. For example, since each of the sections of FIGS. 5 and 6 is assumed to include three grayscales, the section reference number RC' may be equal to the value obtained by multiplying the grayscale reference number RC by three.

In the example of FIG. 6, since each of the target section numbers CS[2], CS[3], and CS[k] exceeds the section reference number RC', the section reference number comparator 143' may provide the target section TS[2] including the highest grayscale TD[4], among the target sections TS[2], TS[3], and TS[k], as the selected target section TS[1].

The power voltage control value transmitter 144' may include the control value look-up table CLUT' in which power voltage control values corresponding to the sections are recorded, and may provide a power voltage control value VCS' corresponding to the selected target section TS[1] to the power voltage supplier 150*a*. Since the control value look-up table CLUT' of the second exemplary embodiment requires a smaller storage space than the control value look-up table CLUT of the first exemplary embodiment, it is possible to reduce the configuration cost of the memory or the like. For example, when the number of grayscales constituting each section is three, the control value look-up table CLUT' requires only a third of the storage space of the control value look-up table CLUT.

According to an exemplary embodiment, in the control value look-up table CLUT', the power voltage control values VCS' each corresponding to the highest grayscale of each section may be recorded. For example, in the control value look-up table CLUT', the power voltage control value VCS' corresponding to the grayscale TD[1] is recorded for the section TS[1], and the power supply voltage control value VCS' corresponding to the grayscale TD[4] is recorded for the section TS[2].

The power voltage may be the power voltage ELVSS applied to the cathode electrode of the organic light emitting diode OLED or the power voltage ELVDD applied to the anode electrode of the organic light emitting diode OLED.

When the power voltage ELVSS is controlled, the power voltage control value VCS' may correspond to a smaller power voltage as the power voltage control value VCS' corresponds to a higher grayscale section. In other words, as the selected target section TS[1] includes a higher grayscale, the power voltage supplier 150*a* may provide the power voltage ELVSS having a smaller voltage value. Therefore, the required power proportional to the difference between the power voltages ELVDD and ELVSS may be secured. Therefore, when the organic light emitting diode OLED emits light at grayscales in the selected target section TS[1], luminance degradation may not occur or be reduced.

Each of the power voltage control values VCS' may correspond to the power voltage ELVSS having the voltage value causing an insufficient luminance for higher grayscales than a highest grayscale of the section corresponding to each of the power voltage control values VCS'. That is, for example, the power supplied in accordance with the power voltage control value VCS' is sufficient for the organic light emitting diode OLED to emit light with the grayscales TD[6], TD[5], and TD[4] which are included in the selected target section TS[1]. However, the supplied power may be insufficient for the organic light emitting diode OLED to emit light with the grayscales TD[3], TD[2], and TD[1] which are higher than the highest grayscale TD[4] of the selected target section TS[1]. That is, luminance degradation may occur for higher grayscales than the highest grayscale in the selected target section TS[1].

Even if such degradation in luminance occurs, the number of pixels with reduced luminance is less than the experimentally determined grayscale reference number RC, so that image degradation is less observed. Therefore, according to the exemplary embodiment, it is possible to appropriately balance the tradeoff relationship between power consumption reduction and image quality degradation.

When the power voltage ELVDD is controlled, the power voltage control value VCS' may correspond to a bigger power voltage as the power voltage control value VCS' corresponds to a higher grayscale section. In other words, as the selected target section TS[1] includes a higher grayscale, the power voltage supplier 150*a* may provide the power voltage ELVSS having a bigger voltage value. Therefore, the required power proportional to the difference between the power voltages ELVDD and ELVSS may be secured. Therefore, when the organic light emitting diode OLED emits light at grayscales in the selected target section TS[1], luminance degradation may not occur or be reduced.

Each of the power voltage control values VCS' may correspond to the power voltage ELVDD having the voltage value causing an insufficient luminance for higher grayscales than a highest grayscale of the section corresponding to each of the power voltage control values VCS'. That is, for example, the power supplied in accordance with the power voltage control value VCS' is sufficient for the organic light emitting diode OLED to emit light with the grayscales TD[6], TD[5], and TD[4] which are included in the selected target section TS[1]. However, the supplied power may be insufficient for the organic light emitting diode OLED to emit light with the grayscales TD[3], TD[2], and TD[1] which are higher than the highest grayscale TD[4] of the selected target section TS[1]. That is, luminance degradation may occur for higher grayscales than the highest grayscale in the selected target section TS[1].

Even if such degradation in luminance occurs, the number of pixels with reduced luminance is less than the experimentally predetermined grayscale reference number RC, so that image degradation is less observed. Therefore, according to the exemplary embodiment, it is possible to appropriately balance the tradeoff relationship between power consumption reduction and image quality degradation.

Figure 7:
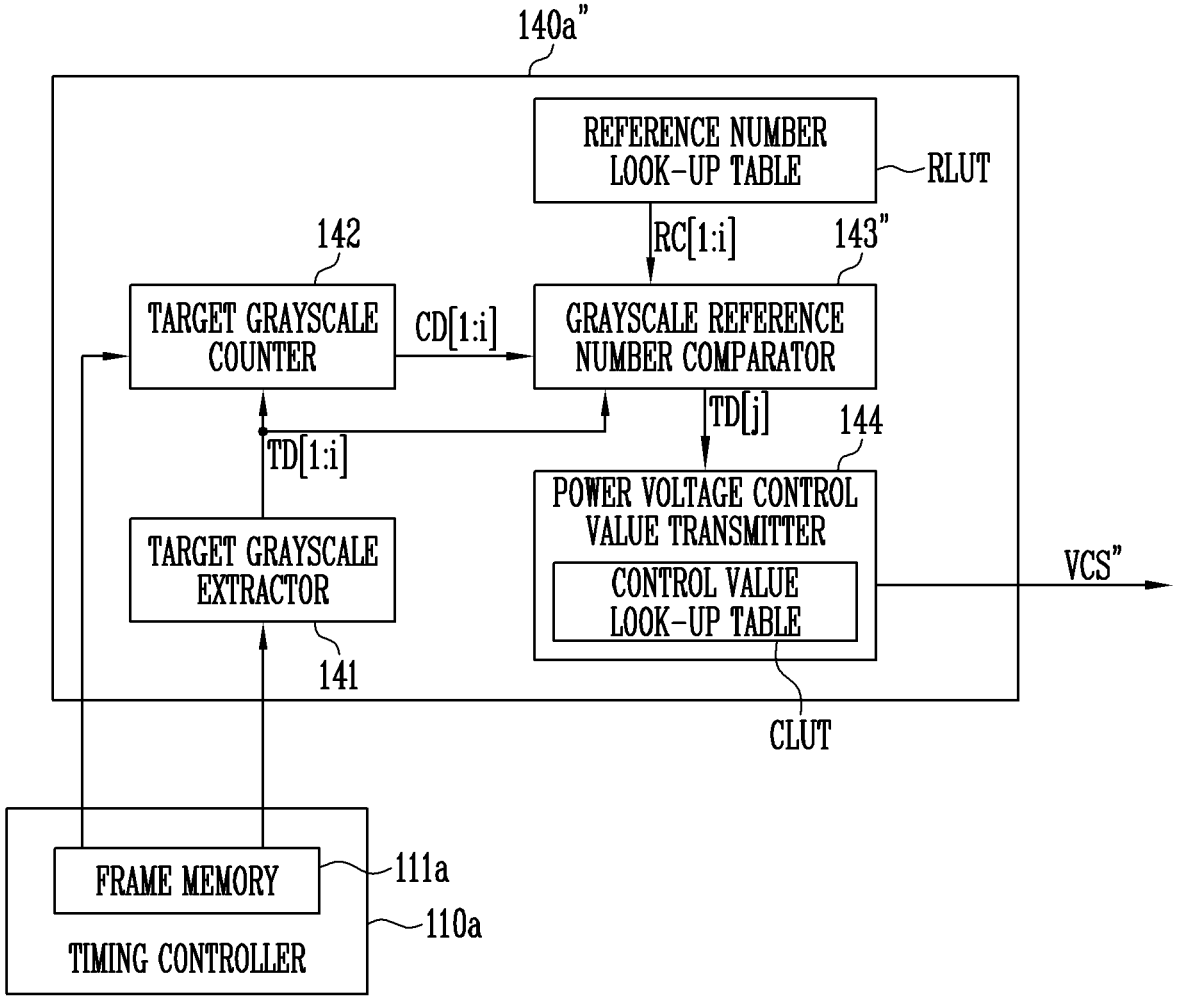
FIG. 7 is a schematic diagram of a power voltage determiner according to a third exemplary embodiment.
Figure 8:
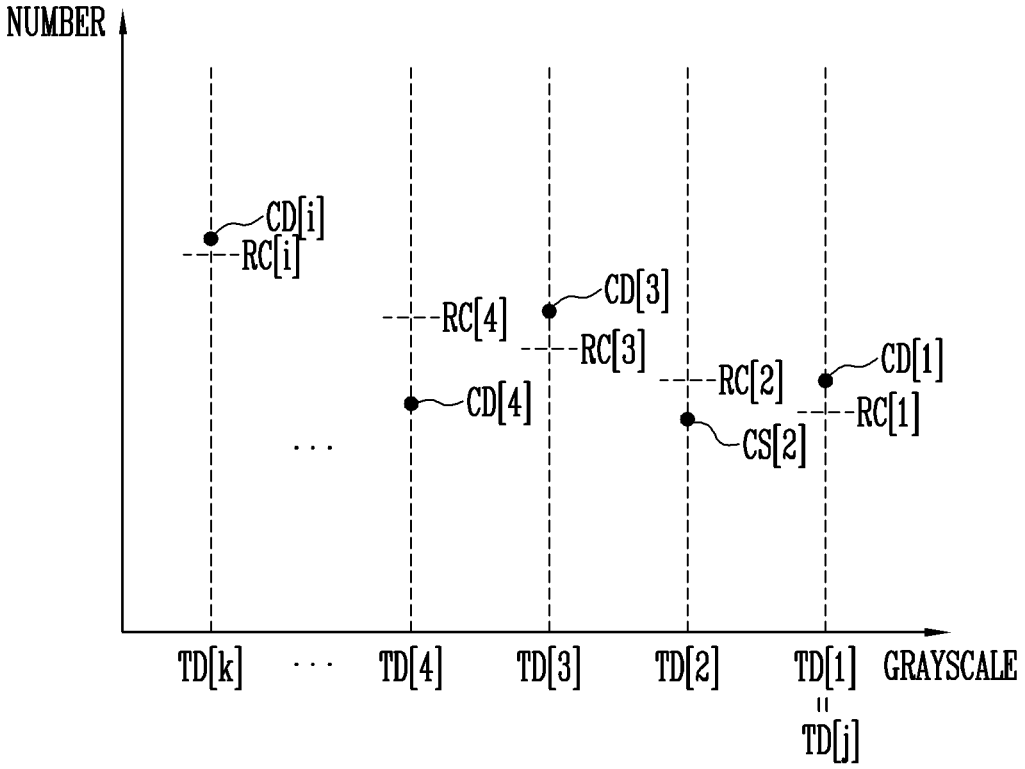
FIG. 8 is a diagram illustrating a procedure for determining a power voltage control value by the power voltage determiner of the third exemplary embodiment.

FIG. 7 is a schematic diagram of a power voltage determiner according to a third exemplary embodiment. FIG. 8 is a diagram illustrating a procedure for determining a power voltage control value by the power voltage determiner of the third exemplary embodiment.

A power voltage determiner 140*a*" of the third exemplary embodiment is different from the power voltage determiner 140*a* of the first exemplary embodiment in that a grayscale reference number comparator 143" has a different configuration and the power voltage determiner 140*a*" further comprises a reference number look-up table RLUT. Since the other components are the same or similar, the repeated description will be omitted.

The power voltage determiner 140*a*" of the third exemplary embodiment uses a plurality of grayscale reference numbers rather than a single grayscale reference number.

The reference number look-up table RLUT may record grayscale reference numbers corresponding to the respective grayscales constituting the target frame.

The grayscale reference number comparator 143" may receive target grayscale reference numbers RC[1:i] corresponding to the target grayscales TD[1:i], and may compare the target grayscale numbers CD[1:i] with the target grayscale reference numbers RC[1:i] to check whether or not each of the target grayscale numbers CD[1:i] exceeds each of the target grayscale reference numbers RC[1:i] corresponding thereto.

Referring to FIG. 8, the target grayscale numbers CD[1], CD[3], and CD[i] exceed the corresponding target grayscale reference numbers RC[1], RC[3], and RC[i]. Therefore, the grayscale reference number comparator 143" determines the target grayscale TD[1], which is the highest grayscale among the target grayscales TD[1], TD[3], and TD[i], as the selected target grayscale TD[j], and provides the selected target grayscale TD[j] to the power voltage control value transmitter 144. The subsequent steps are the same or similar to those illustrated in the first exemplary embodiment.

The third exemplary embodiment may cause an increase in configuration cost because it further includes the reference number look-up table RLUT as compared with the first exemplary embodiment. However, since the optimum reference number may be provided for each grayscale, optimal balancing may be provided for a plurality of image frames including different highest grayscales from each other.

According to the exemplary embodiment, the grayscale reference numbers recorded in the reference number look-up table RLUT may have a smaller value corresponding to a higher grayscale. According to the exemplary embodiment, by further increasing a weight value for the higher grayscale, it is possible to prevent the image quality degradation with respect to the higher grayscale which is easily observed.

Figure 9:
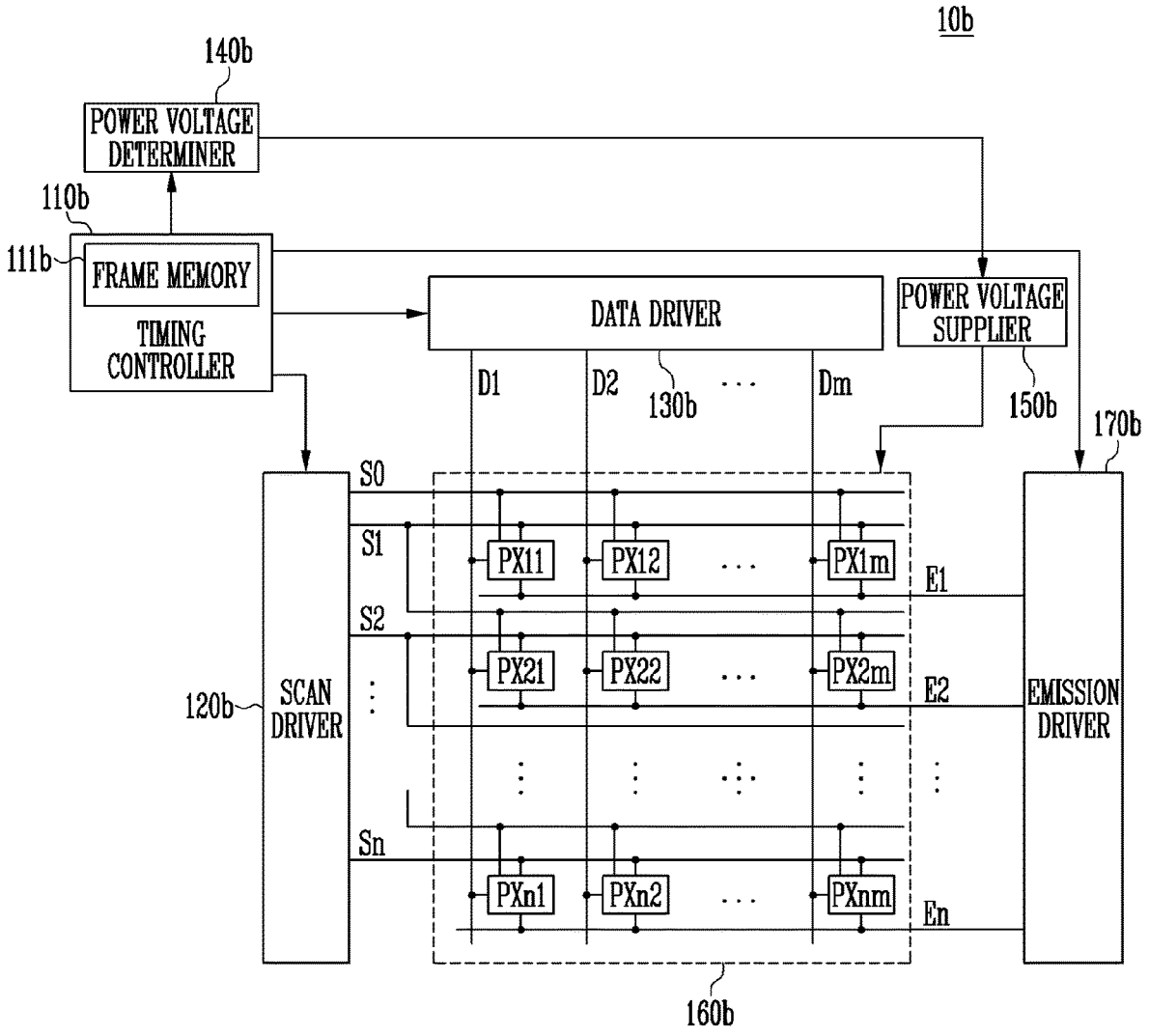
FIG. 9 is a schematic diagram of a display device according to an exemplary embodiment.
Figure 10:
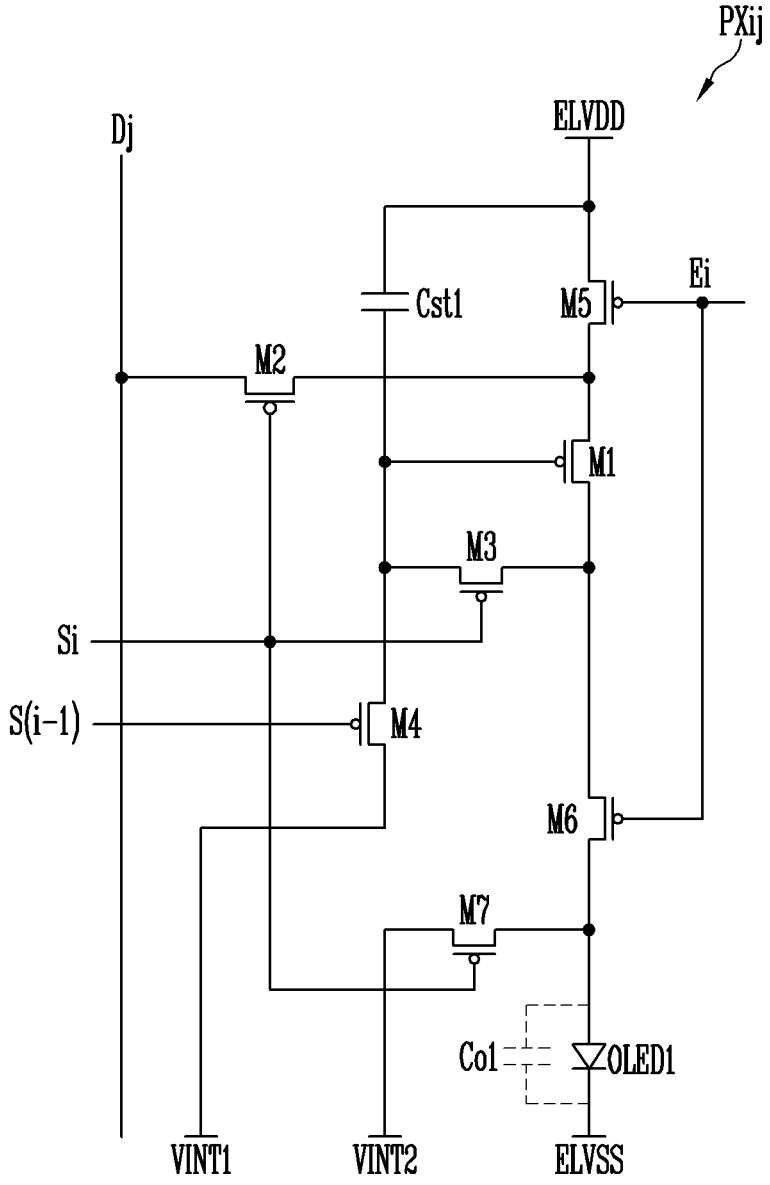
FIG. 10 is a schematic diagram of a pixel according to the exemplary embodiment.

FIG. 9 is a schematic diagram of a display device according to an exemplary embodiments. FIG. 10 is a schematic diagram of a pixel according to the exemplary embodiments.

Referring to FIG. 9, a display device 10*b* according to exemplary embodiments includes a timing controller 110*b*, a scan driver 120*b*, a data driver 130*b*, a power voltage determiner 140*b*, a power voltage supplier 150*b*, a pixel unit 160*b*, and an emission driver 170*b*. The timing controller 110*b*, the scan driver 120*b*, the data driver 130*b*, the power voltage determiner 140*b*, and the power voltage supplier 150*b* of the display device 10*b* are the same or similar to those of the display device 10*a*. Therefore, the repeated description will be omitted.

The emission driver 170*b* supplies emission signals to the corresponding pixel rows through emission lines E1, E2, . . . , En. The emission driver 170*b* may sequentially supply the emission signals of a turn-off level to the respective emission lines E1, E2, . . . , En. The driving current is blocked to the pixel row connected to the emission line to which the emission signal of the turn-off level is applied, so that the organic light emitting diodes do not emit light. This will be described with reference to the pixel circuit of FIG. 10.

Referring to FIG. 10, a pixel PXij includes a first transistor M1, a second transistor M2, a third transistor M3, a fourth transistor M4, a fifth transistor M5, a sixth transistor M6, and a seventh transistor M7, a storage capacitor Cst1, and an organic light emitting diode OLED1, as an example.

One electrode of the first transistor M1 may be connected to the other electrode of the fifth transistor M5, the other electrode of the first transistor M1 may be connected to one electrode of the sixth transistor M6, and a gate electrode of the first transistor M1 may be connected to the other electrode of the storage capacitor Cst1. The first transistor M1 may be referred to as a driving transistor. The first transistor M1 determines the amount of driving current flowing between the power voltage ELVDD and the power voltage ELVSS according to the potential difference between the gate electrode and a source electrode.

One electrode of the second transistor M2 may be connected to a data line Dj, the other electrode of the second transistor M2 may be connected to the one electrode of the first transistor M1, and a gate electrode of the second transistor M2 may be connected to the current stage scan line Si. The second transistor M2 may be referred to as a scan transistor. The second transistor M2 draws the data voltage of the data line Dj to the pixel PXij when a scan signal of a turn-on level is applied to the current stage scan line Si.

One electrode of the third transistor M3 may be connected to the other electrode of the first transistor M1, the other electrode of the third transistor M3 may be connected to the gate electrode of the first transistor M1, and a gate electrode of the third transistor M3 may be connected to the current stage scan line Si. The third transistor M3 connects the first transistor M1 in a diode form when a scan signal of a turn-on level is applied to the current stage scan line Si.

One electrode of the fourth transistor M4 may be connected to the gate electrode of the first transistor M1, the other electrode of the fourth transistor M4 may be connected to an initialization voltage VINT1, and a gate electrode of the fourth transistor M4 may be connected to the previous stage scan line S(i−1). In exemplary embodiments, the gate electrode of the fourth transistor M4 may be connected to another scan line. The fourth transistor M4 transfers the initialization voltage VINT1 to the gate electrode of the first transistor M1 when a scan signal of a turn-on level is applied to the previous stage scan line S(i−1), and initializes accumulated charge of the gate electrode of the first transistor M1.

One electrode of the fifth transistor M5 may be connected to the power voltage ELVDD, the other electrode of the fifth transistor M5 may be connected to the one electrode of the first transistor M1, and a gate electrode of the fifth transistor M5 may be connected to an emission line Ei. One electrode of the sixth transistor M6 may be connected to the other electrode of the first transistor M1, the other electrode of the sixth transistor M6 may be connected to an anode electrode of the organic light emitting diode OELD1, and a gate electrode of the sixth transistor M6 may be connected to the emission line Ei. The transistors M5 and M6 may be referred to as emission transistors. The transistors M5 and M6 form a driving current path between the power voltage ELVDD and the power voltage ELVSS to emit light to the organic light emitting diode OELD1 when a light emission signal of a turn-on level is applied.

In the seventh transistor M7, one electrode may be connected to an anode electrode of the organic light emitting diode OLED1, the other electrode may be connected to an initialization voltage VINT2, and a gate electrode may be connected to the current stage scan line Si. In exemplary embodiments, the gate electrode of the seventh transistor M7 may be connected to another scan line. The seventh transistor M7 transfers the initialization voltage VINT2 to the anode electrode of the organic light emitting diode OLED1 when a scan signal of a turn-on level is applied to the current stage scan line Si, and initializes accumulated charge of the organic light emitting diode OLED1.

In the organic light emitting diode OLED1, the anode electrode may be connected to the other electrode of the sixth transistor M6, and a cathode electrode may be connected to the power voltage ELVSS. In order to explain the charge accumulation of the organic light emitting diode OLED1, a capacitance Col may be illustrated.

Hereinafter, a driving method of the pixel PXij will be described.

When the previous stage scan signal of a turn-on level is supplied through the previous stage scan line S(i−1), the fourth transistor M4 is turned on and the charge amount of the gate electrode of the first transistor M1 is initialized. Next, when the current stage scan signal of a turn-on level is supplied through the current stage scan line Si, the transistors M2 and M3 are turned on and the potential difference between the power voltage ELVDD and the data voltage applied to the data line Dj is recorded in the storage capacitor Cst1. Since the seventh transistor M7 is also turned on, the amount of charge accumulated in the capacitance Co 1 of the organic light emitting diode OLED1 is initialized. Since the emission signal of a turn-off level is applied on the emission line Ei during the aforementioned steps, the transistors M5 and M6 are in the turned off state and the driving current path of the organic light emitting diode OLED1 is blocked. Therefore, the organic light emitting diode OLED1 does not emit light. Next, when the emission signal of the turn-on level is supplied, the transistors M5 and M6 are turned on, the driving current flows to the organic light emitting diode OLED1, and the organic light emitting diode OLED1 emits light. An emitting grayscale of the organic light emitting diode OLED1 is determined by the first transistor M1 which is turned on in response to the voltage recorded in the storage capacitor Cst1.

Since the pixel PXij in FIG. 10 is also driven by using the power voltages ELVDD and ELVSS, the exemplary embodiments of the power voltage determiner described in FIGS. 1 to 8 may be applied.

In the display device and the driving method thereof according to the present disclosure, it is possible to appropriately balance the tradeoff relationship between power consumption reduction and image degradation.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The power voltage determiner, controllers, generators, calculators, units, and other processing features of the exemplary embodiments disclosed herein may be implemented in logic which, for example, may include hardware, software, or both. When implemented at least partially in hardware, the power voltage determiner, controllers, generators, calculators, units, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the power voltage determiner, controllers, generators, calculators, units, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Some of the advantages that may be achieved by exemplary embodiments of the invention and/or exemplary methods of the invention include improved balance in the tradeoff relationship between power consumption reduction and image quality degradation.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

pixels including organic light emitting diodes configured to emit light depending on grayscales constituting a target frame, wherein the pixels receive data voltages corresponding to the grayscales through data lines and a power voltage through one electrode of each of the organic light emitting diodes;

a power voltage supplier configured to supply the power voltage to the one electrode of each of the organic light emitting diodes; and a power voltage determiner configured to:

extract target grayscales in descending order from a highest grayscale among the grayscales; and determine a voltage value of the power voltage based on each number of the target grayscales by referring to a control value look-up table, wherein the power voltage determiner comprises the control value look-up table including power voltage control values corresponding to grayscales, and wherein each of the power voltage control values corresponds to a smaller power voltage as each of the power voltage control values correspond to a higher grayscale.

2. The display device of claim 1, wherein the power voltage determiner is configured to:

compare each number of the target grayscales with a grayscale reference number; and determine the voltage value of the power voltage based on a selected target grayscale which is a highest grayscale among the target grayscales having a number exceeding the grayscale reference number.

3. The display device of claim 2, wherein the one electrode of each of the organic light emitting diodes is a cathode electrode.

4. The display device of claim 3, wherein the power voltage determiner is configured to provide a power voltage control value corresponding to the selected target grayscale to the power voltage supplier.

5. The display device of claim 4, wherein each of the power voltage control values corresponds to the power voltage having the voltage value causing an insufficient luminance for higher grayscales than each of the grayscales corresponding to each of the power voltage control values.

6. The display device of claim 1, wherein the power voltage determiner comprises a reference number look-up table comprising grayscale reference numbers corresponding to the grayscales, respectively, and wherein the power voltage determiner is configured to:

compare each number of the target grayscales with a corresponding target grayscale reference number among the grayscale reference numbers; and determine the voltage value of the power voltage based on a selected target grayscale which is a highest grayscale among the target grayscales having a number exceeding the corresponding target grayscale reference number.

7. The display device of claim 6, wherein the one electrode of each of the organic light emitting diodes is a cathode electrode.

8. The display device of claim 7, wherein each of the power voltage control values corresponds to the power voltage having the voltage value causing an insufficient luminance for higher grayscales than each of the grayscales corresponding to each of the power voltage control values.

9. A display device comprising:

pixels including organic light emitting diodes configured to emit light depending on grayscales constituting a target frame, wherein the pixels receive data voltages corresponding to the grayscales through data lines and a power voltage through one electrode of each of the organic light emitting diodes;

a power voltage supplier configured to supply the power voltage to the one electrode of each of the organic light emitting diodes; and a power voltage determiner configured to:

extract target sections in descending order from a section having a highest grayscale among sections, each of the sections having at least two of the grayscales as a group, and determine a voltage value of the power voltage based on each number of the target sections by referring to a control value look-up table, wherein the power voltage determiner comprises the control value look-up table comprising power voltage control values corresponding to the sections, and wherein each of the power voltage control values corresponds to a smaller power voltage as each of the power voltage control values corresponds to a higher grayscale section.

10. The display device of claim 9, wherein the power voltage determiner is configured to:

compare each number of the target sections with a section reference number; and determine the voltage value of the power voltage based on a selected target section having a highest grayscale among the target sections having a number exceeding the section reference number.

11. The display device of claim 10, wherein the one electrode of each of the organic light emitting diodes is a cathode electrode.

12. The display device of claim 11, wherein the power voltage determiner is configured to provide a power voltage control value corresponding to the selected target section to the power voltage supplier.

13. The display device of claim 12, wherein each of the power voltage control values corresponds to the power voltage having the voltage value causing an insufficient luminance for higher grayscales than a highest grayscale of each of the sections corresponding to each of the power voltage control values.

14. A driving method of a display device comprising pixels including organic light emitting diodes configured to emit light depending on grayscales, the driving method comprising:

extracting target grayscales in descending order from a highest grayscale among the grayscales constituting a target frame;

counting each number of the target grayscales;

determining a voltage value of a power voltage based on each number of the target grayscales by referring to a control value look-up table; and supplying the power voltage to one electrode of each of the organic light emitting diodes of the pixels, wherein the pixels receive data voltages corresponding to the grayscales through data lines, wherein the control value look-up table comprises power voltage control values corresponding to the grayscales, and wherein each of the power voltage control values corresponds to a smaller power voltage as each of the power voltage control values corresponds to a higher grayscale.

15. A driving method of a display device comprising pixels including organic light emitting diodes configured to emit light depending on grayscales, the driving method comprising:

extracting target sections in descending order from a section including a highest grayscale among sections, wherein each of the sections has at least two of the grayscales as a group, and wherein the grayscales constitute a target frame;

counting each number of the target sections;

determining a voltage value of a power voltage based on each number of the target sections by referring to a control value look-up table; and supplying the power voltage to one electrode of each of the organic light emitting diodes of the pixels, wherein the pixels receive data voltages corresponding to the grayscales through data lines, wherein the control value look-up table comprises power voltage control values corresponding to the sections, and wherein each of the power voltage control values corresponds to a smaller power voltage as each of the power voltage control values corresponds to a higher grayscale section.

* * * * *